US007588393B1

(12) United States Patent
Shivers, III et al.

(10) Patent No.: US 7,588,393 B1
(45) Date of Patent: Sep. 15, 2009

(54) METHOD FOR SUPPORTING TOP TENSION DRILLING AND PRODUCTION RISERS ON A FLOATING VESSEL

(75) Inventors: Robert Magee Shivers, III, Houston, TX (US); David Trent, Cypress, TX (US); Daniel H. Longwell, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 12/203,026

(22) Filed: Sep. 2, 2008

(51) Int. Cl.
*B63B 35/44* (2006.01)
*E21B 17/01* (2006.01)

(52) U.S. Cl. ..... 405/224.4; 405/223.1; 166/352; 166/367

(58) Field of Classification Search ..... 405/224.4, 405/224.2, 223.1; 166/350, 352, 355, 367
See application file for complete search history.

(56) References Cited

U.S. PATENT DOCUMENTS

| | | | | |
|---|---|---|---|---|
| 4,379,657 | A * | 4/1983 | Widiner et al. | 405/224.4 |
| 5,252,004 | A * | 10/1993 | Butler et al. | 405/224.4 |
| 7,231,981 | B2 * | 6/2007 | Moe et al. | 405/224.4 |
| 7,329,070 | B1 * | 2/2008 | Trent et al. | 405/224.4 |
| 2005/0147473 | A1 * | 7/2005 | Pallini et al. | 405/224.4 |
| 2007/0196182 | A1 * | 8/2007 | Ellis | 405/224.4 |
| 2008/0031692 | A1 * | 2/2008 | Wybro et al. | 405/224.4 |

* cited by examiner

*Primary Examiner*—Frederick L Lagman
(74) *Attorney, Agent, or Firm*—Buskop Law Group, P.C.; Wendy Buskop

(57) ABSTRACT

A method for supporting top tension drilling and production risers on a floating vessel using a tensioner assembly above the water line of the vessel. The method can include attaching at least one hydraulic cylinder on a first end to a first position on a floating vessel and on a second end to a tension frame below the first position. The next step of the method can be forming a fluid connection between the at least one hydraulic cylinder and at least one primary accumulator.

12 Claims, 8 Drawing Sheets

METHOD FOR SUPPORTING TOP TENSION DRILLING AND PRODUCTION RISERS ON A FLOATING VESSEL

FIELD

The present embodiments relate to a method for supporting top tension drilling and production risers on a floating vessel.

BACKGROUND

A need exists for a method for supporting top tension drilling and production risers, which eliminates the need for riser centralizers or stabilization between a tension ring, and well head equipment when the tensioner stroke range is large. A need exists for a method for supporting method for supporting top tension drilling and production risers that achieves stabilization by compensating a conductor, which transfers tension from the cylinders to the riser.

A need further exists for a method for supporting top tension drilling and production risers that utilizes a conductor that can protect the riser from impact with a vessel, and which can provide shelter from wave loading in a wave zone.

The present embodiments meet these needs.

BRIEF DESCRIPTION OF THE DRAWINGS

The detailed description will be better understood in conjunction with the accompanying drawings as follows.

Figure 1:
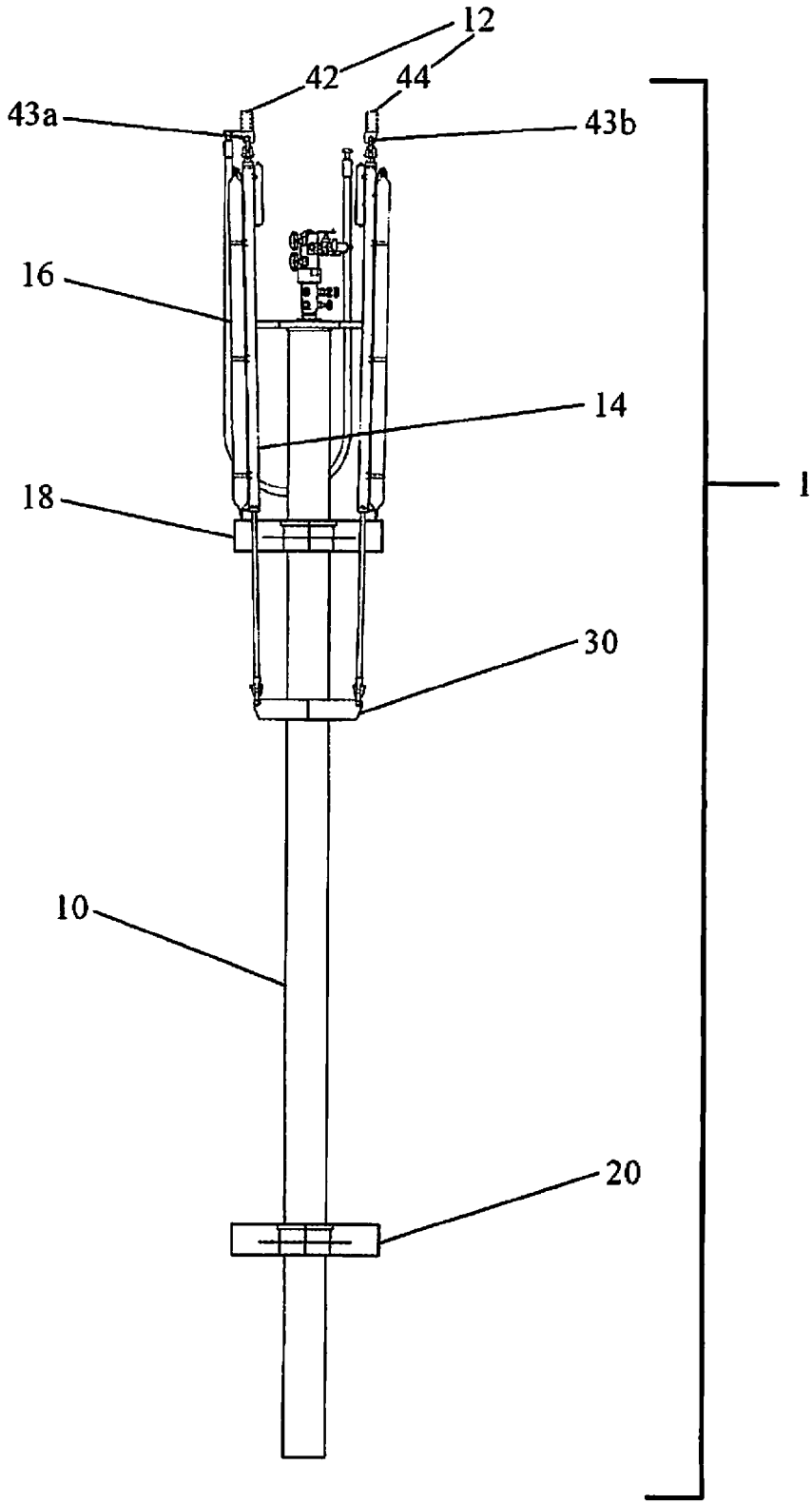
FIG. 1 depicts front view of the tensioner assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments can provide stabilization of a riser and reduce the equipment needed to stabilize the riser. This reduces costs associated with riser systems, and enhances the safety of the riser system.

The embodiments generally relate to a method for supporting top tension drilling and production risers on a floating vessel. The floating vessel for supporting top tension drilling and production risers has a hull and an operation deck disposed on top of the hull.

The floating vessel can be a semi-submersible floating vessel, a ship, a deep draft cassion, barge, a tension leg platform, or a similar floating vessel.

An embodiment of the method for supporting top tension drilling and production risers on a floating vessel using a tensioner assembly above the water line of the vessel can include the step of attaching at least one hydraulic cylinder on a first end to a first position on a floating vessel. A second end of the hydraulic cylinder can be attached to a tension frame below the first position.

In an embodiment of the method the hydraulic cylinder can be secured to the floating vessel using shackles, pins, or another rotating member adapted to form a rotatable joint.

The method can include attaching a plurality of hydraulic cylinders to the floating vessel. In this embodiment the method can include simultaneously using each hydraulic cylinder to apply tension to a plurality of risers within a plurality of conductors.

The hydraulic cylinder can apply a tension of at least 200 kips to the conductor. The hydraulic cylinders can have a pressure from about 100 psi to about 3500 psi, and can provide a load from about 200 kips to about 2500 kips.

In an embodiment of the method a support frame can be used to mount the at least one hydraulic cylinder and the at least one primary accumulator, and the support frame can be secured to the floating vessel.

In an embodiment the support frame can have a first beam and a second beam. The first beam and the second beam can be an I-beam, a C-channel beam, a tubular, or a similar support beam.

The pad eyes can have a diameter for receiving a shackle to hold the hydraulic cylinders. The pad eyes can be disposed on the beams or they can be integral with the deck of a vessel.

In another embodiment the support frame can be a cassette. The support frame can be secured to the floating vessel by welding. It is also possible that the support frame can be a self supporting frame disposed on the vessel.

The method can continue by forming a fluid connection between the at least one hydraulic cylinder and at least one primary accumulator. The accumulator can have a capacity of at least 1 gallon. The accumulator capacity can exceed 470 gallons.

The fluid connection can be a direct connection. In another embodiment the primary accumulator can be disposed remote from the hydraulic cylinder and pluming can be used to fluidly communicate the primary accumulator to the hydraulic cylinder. Examples of the method of pluming the accumulator to the hydraulic cylinder include using an umbilical cord, a tubular steel pipe, a flex pipe, or similar fluid communication device.

Each primary accumulator can be secured proximate to one of the hydraulic cylinders, or the primary accumulator can be remote to the hydraulic cylinder. It is possible to arrange the primary accumulators on the floating vessel remote from the hydraulic cylinder in a stacked module, thereby, forming a small footprint on the floating vessel.

An example of the accumulator being disposed proximate to the hydraulic cylinder would be mounting on the vessel close to the first position, or in another embodiment the accumulator can be secured to a support frame that is supporting the hydraulic cylinder.

An example of the accumulator being mounted remote from the hydraulic cylinder could include mounting the accumulators on a different deck, or on the same deck approximately about 30 feet to about 40 feet from the hydraulic cylinder.

The method can include securing a conductor disposed between a wellhead and a piece of well access equipment to the tension frame. The conductor can be bolted to the tension frame, welded to the tension frame, or connected to the tension frame in a similar manner. The conductor can be a fifty four inch outside diameter steel pipe. A riser can be disposed within the conductor.

The tension frame can be made from steel and can have a square, round, or rectangular shape.

After the conductor is secured to the tension frame the step of centralizing the conductor in an upper conductor guide and a lower conductor guide is performed. The upper conductor guide and the lower conductor guide are secured to the floating vessel.

The upper and lower conductor guides can each have a guide frame for supporting a conductor guide wear pad using a conductor guide retaining ring.

The upper conductor guide and the lower conductor guide can have different dimensions. The upper conductor guide and the lower conductor guide can be made from metal, composite, or similar structural material. The lower conductor guide can be made from the same or different material as the upper conductor guide.

The conductor guide frame can be metal, composite, or similar structural material. The conductor guide frame support conductor guide wear pads using a conductor guide retaining ring. The conductor guide retaining ring can be metal, composite, or any structural material. The conductor guide ring can be attached to the conductor guide frame by bolting, welding, or similar mechanical means. The conductor guide ring can be a complete ring or a segment of a ring.

The conductor guide wear pad can be made from an ultra high molecular weight polymer. The ultra high molecular weight polymer can be polypropylene, polyethylene, polybutylene, homopolymer, and copolymers thereof. The conductor wear pads can also be metal or any bearing material.

The method can continue by applying tension to a riser within the conductor using the at least one hydraulic cylinder. The conductor slidabley supports top tension drilling and production risers. The risers can be in contact with the piece of well access equipment.

The piece of well access equipment can include a blow out preventer, a production tree, or similar pieces of well access equipment.

In an embodiment of the method the tensioner assembly can have a tension ring assembly disposed on the conductor above the upper conductor guide. The tension ring assembly can be a tapered bowl tension ring assembly.

The tapered bowl tension ring assembly can include a tension disc having a tapered center. Tapered collets can engage the tension disc and a collet support ring can be disposed on the tapered collets to hold the collets together. The collet support ring can be steel or another structural and stiff member. The tapered collets engage the riser and are held together by the collet support ring.

The collet support ring is secured to the tension disc. The tension disc can have an outer diameter segment that engages the conductor with a thickness that is about 50 percent to about 70 percent the thickness of the inner diameter segment of the tension disc. The tension disc engages the collets that engage the riser. The tension disc can be made from metal and can have a diameter ranging from about 28 inches to about 63 inches.

In another embodiment the tension ring assembly can include a single tension disc directly engaging the conductor, and supporting the riser.

In an alternative embodiment the tension disc can be a solid segment with perforations.

The embodiments of the invention can be best understood with reference to the Figures.

Figure 2:
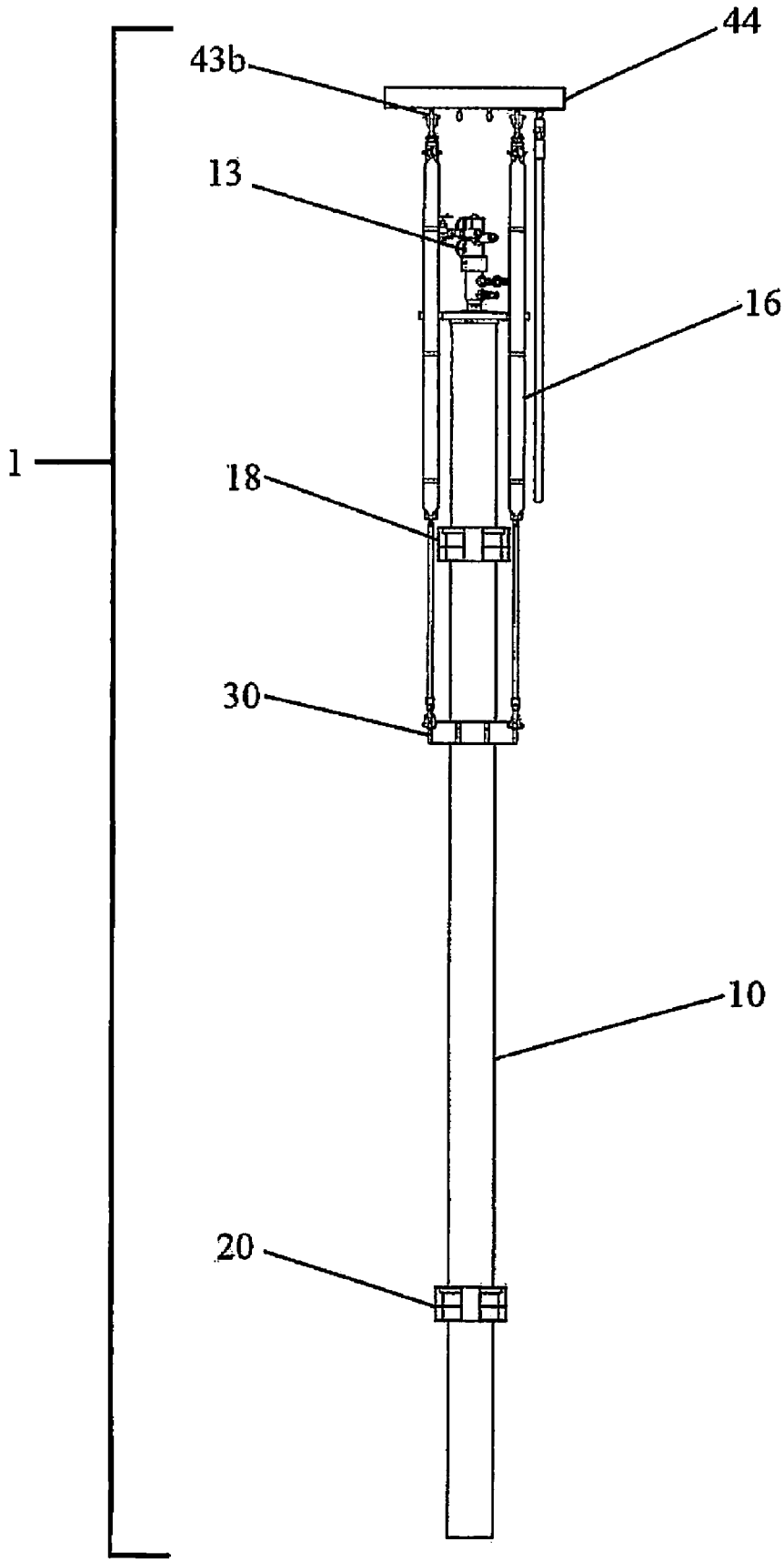
FIG. 2 depicts a side view of the tensioner assembly.
Figure 6:
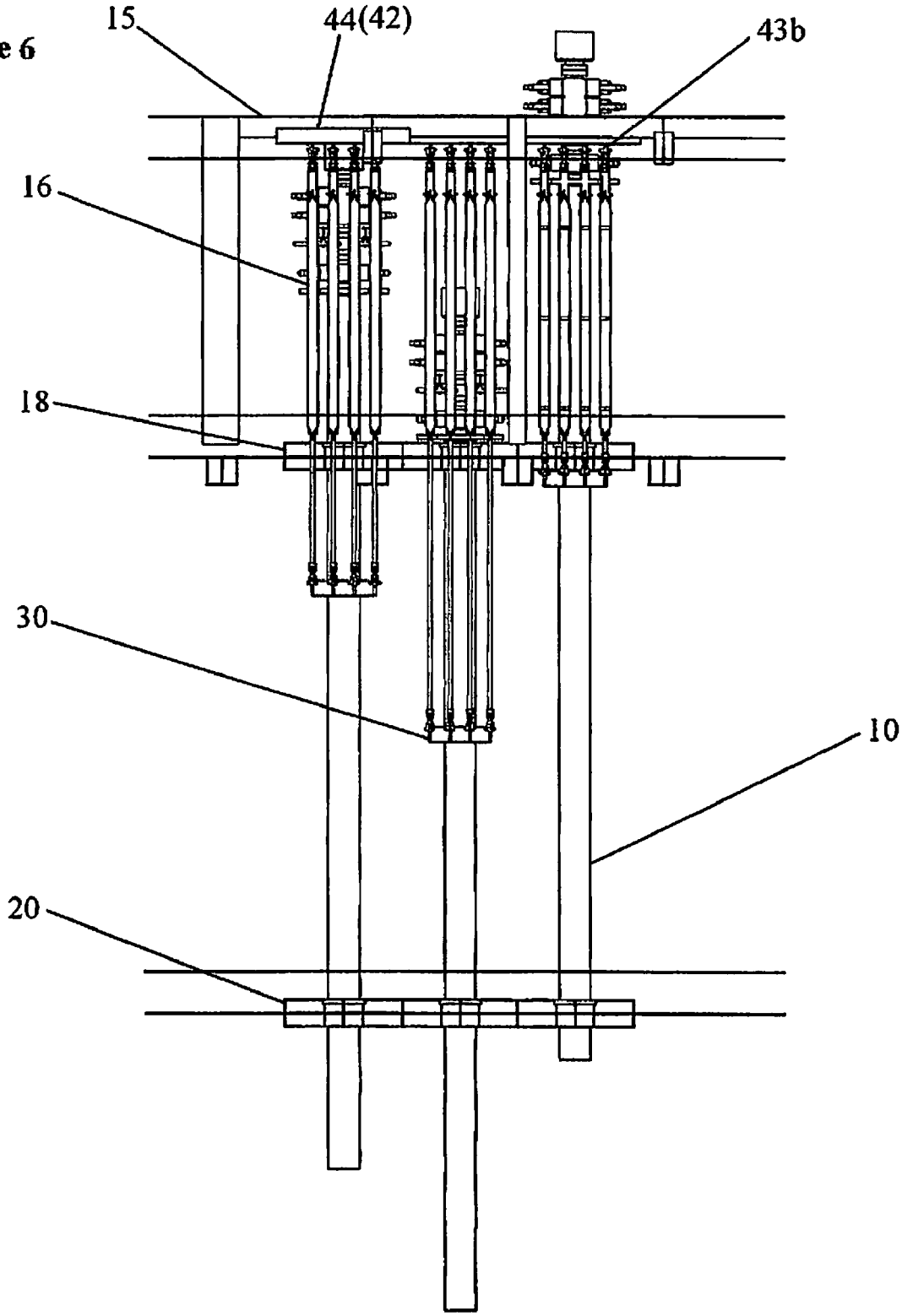
FIG. 6 depicts a side view of the tensioner assembly secured to a vessel.

Referring now to FIGS. 1, 2, and 6, the tensioner assembly 1 has a conductor 10. A tension frame 30 is secured to the conductor 10 and at least one hydraulic cylinder 14. The hydraulic cylinder 14 is secured to a support frame 12. The support frame 12 is depicted having a first beam 42 parallel to a second beam 44. The first beam 42 and the second beam 44 can be connected to a rig 15. A first beam pad eye 43*a* is disposed on the first beam 42. A second beam pad eye 43*b* is disposed on the second beam 44.

A primary accumulator 16 is depicted in direct fluid communication with the hydraulic cylinder 14.

An upper conductor guide 18 and a lower conductor guide 20 slidably engage the conductor 10.

The tension frame 30 transfers tension from the hydraulic cylinder 14 to the conductor 10, then to a riser 32 and a piece of well access equipment 13, as depicted.

Figure 3:
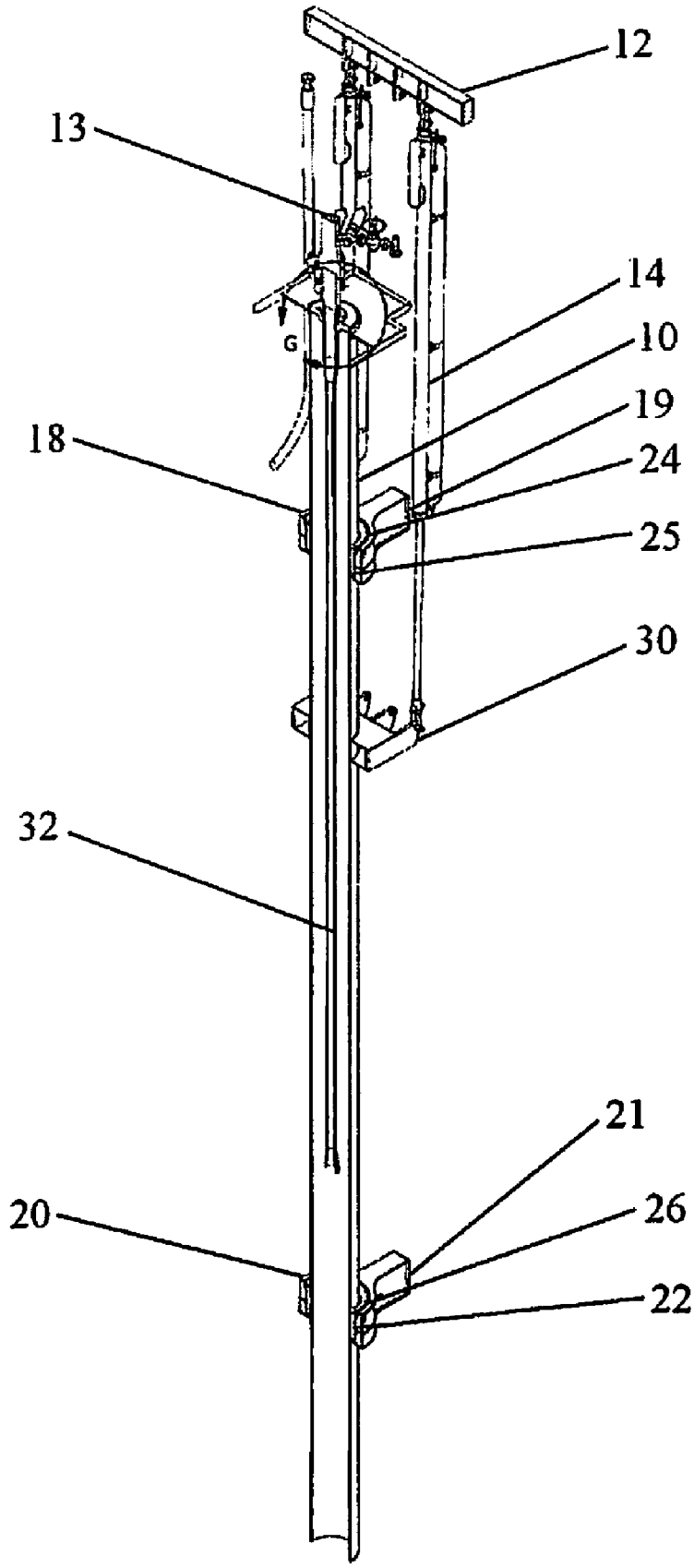
FIG. 3 is a cut view of the tensioner assembly.

FIG. 3 shows a cut view of the tensioner assembly 1. The well access equipment 13 is depicted secured to the conductor 10. The conductor 10 is secured to the well access equipment by a tension disc. The riser 32 extends through the center of the conductor 10. The hydraulic cylinder 14 is depicted secured to the tension frame 30 and the support frame 12.

The upper conductor guide retaining ring 24 is used to secure an upper conductor guide wear pad 25 to the upper conductor guide frame 19. The upper conductor guide ring 24, the upper conductor guide wear pad 25, and the upper conductor guide frame 19, form the upper conductor guide 18.

The lower conductor guide retaining ring 26 is used to secure a lower conductor guide wear pad 22 to the lower conductor guide frame 21. The lower conductor guide ring 26, the lower conductor guide wear pad 22, and the lower conductor guide frame 21, form the lower conductor guide 20.

Figure 4:
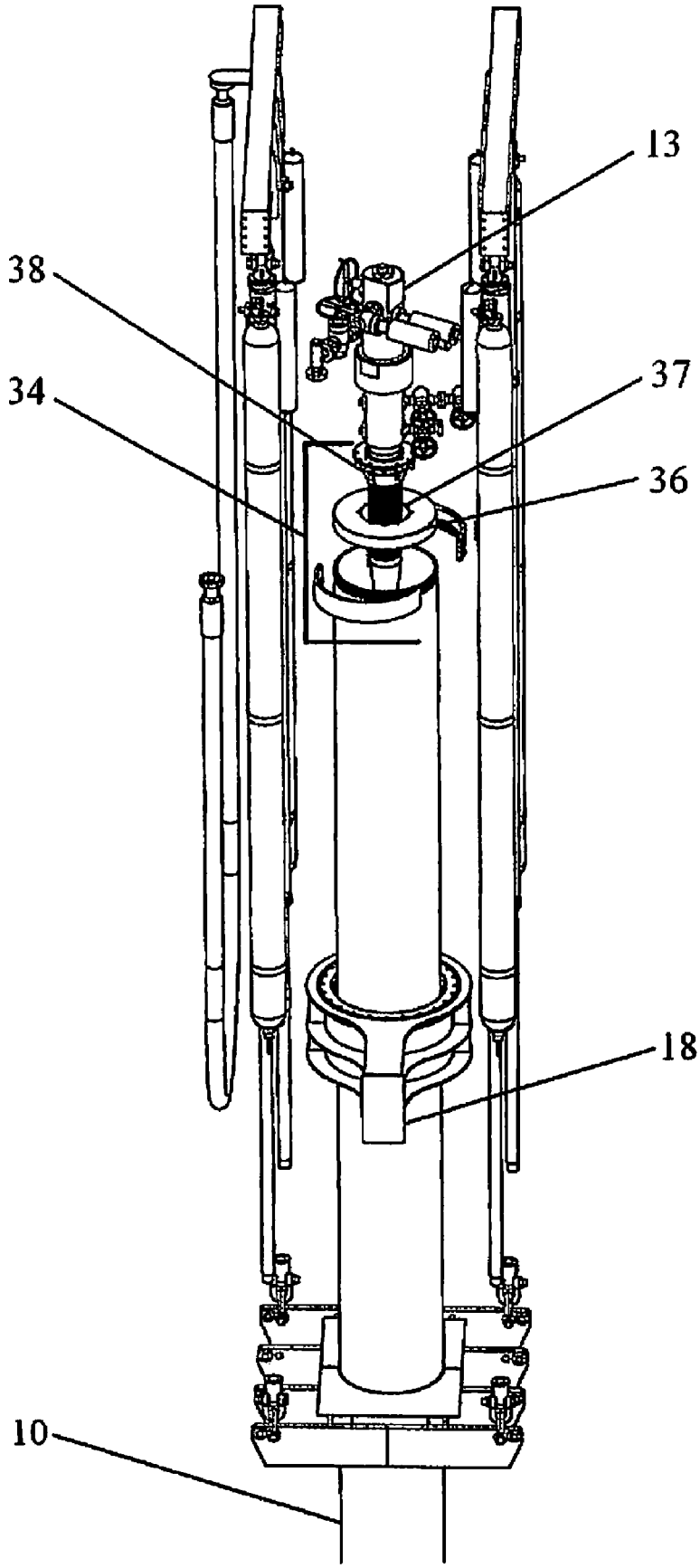
FIG. 4 is an exploded view of an embodiment of the tapered bowl tension ring assembly.
Figure 5:
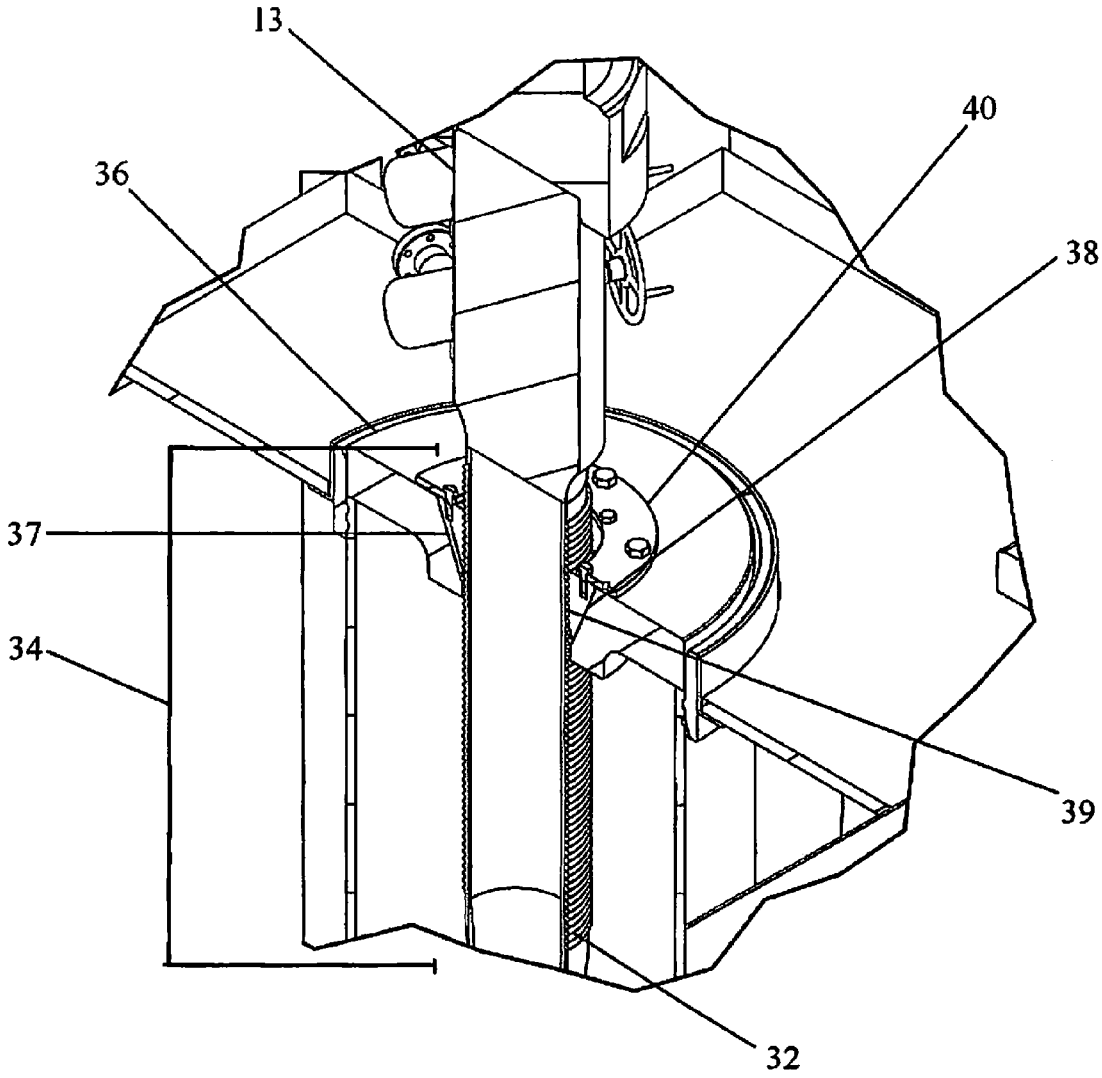
FIG. 5 is a cut view of an embodiment of the tapered bowl tension ring assembly.

Turning now to FIG. 4 and FIG. 5. A tapered bowl tension ring assembly 34 is depicted. The tapered bowl tension ring assembly 34 is disposed on the conductor 10 above the upper conductor guide 18.

The tapered bowl tension ring assembly 34 includes a tension disc 36. The tension disc 36 is depicted having a tapered center 37 for engaging the tapered collets 38. The tapered center 37 can be best seen in FIG. 5. The tapered center 37 can have a diameter for fitting commonly used riser diameters.

The tapered bowl assembly 34 has tapered collets 38 on threads 39. The threads 39 can be grooves. The threads 39 are for engaging the riser 32 in a secure connection. The tapered collets 38 engage the tension disc 36. A collet support ring 40 is disposed on the tapered collets 38 for supporting the tapered collets 38. The well access equipment 13 is depicted connected to the riser 32.

Figure 7:
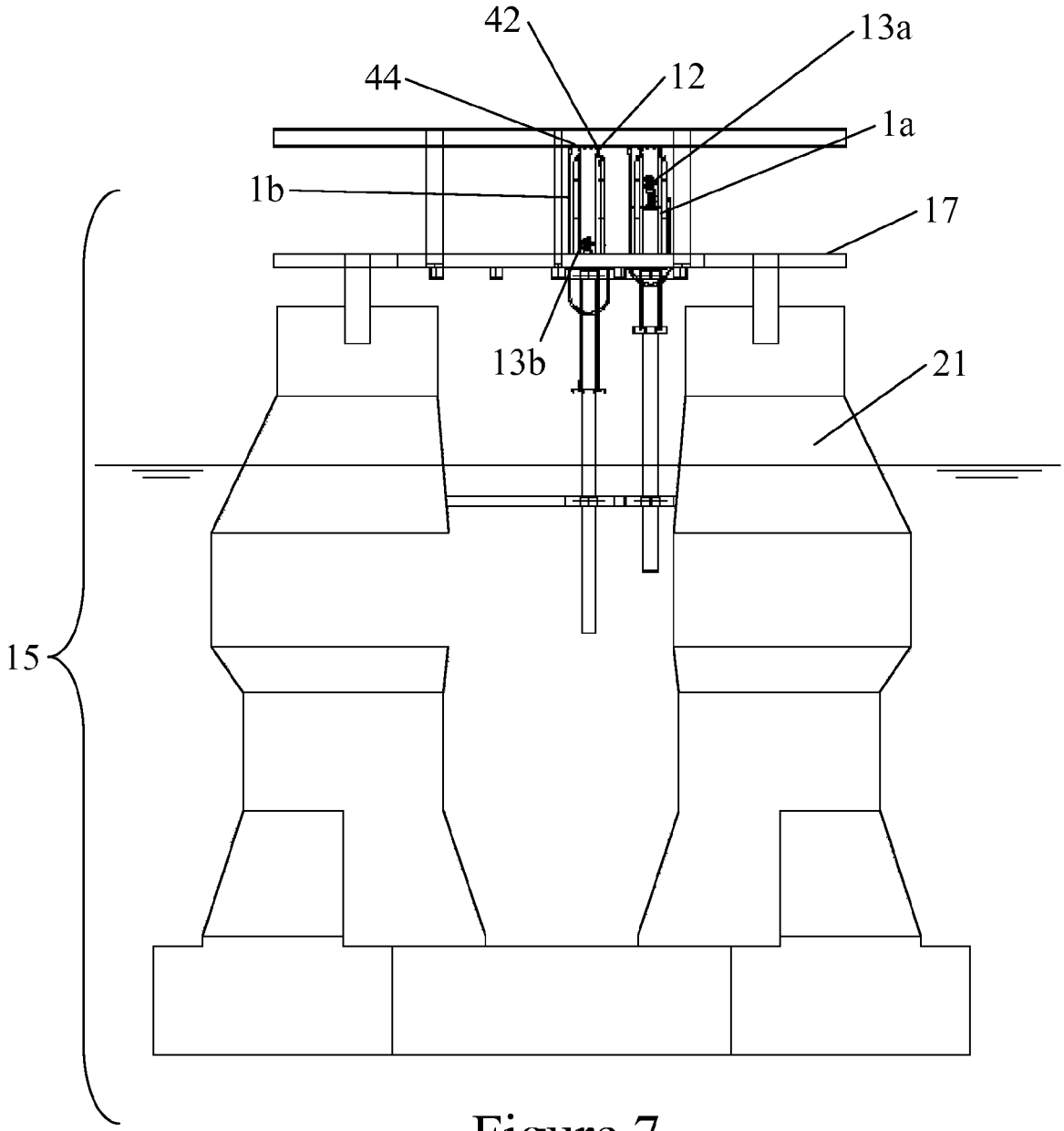
FIG. 7 depicts a side view of the floating vessel that can be used with the embodiments of the method.

FIG. 7 depicts a side view of the floating vessel 15 for supporting top tension drilling and production risers. The floating vessel 15 supports a first tensioner 1*a* and a second tensioner assembly 1*b*. The tensioner assemblies are described in detail below. The floating vessel for drilling operations is in communication with a wellhead. The wellhead is not shown.

The floating vessel for drilling operations has a hull 21 with an operations deck 17 disposed on the top of the hull 21.

The second tensioner assembly 1*b* and the first tension assembly 1*a* have a support frame 12. The support frame 12 has a first beam 42 parallel to a second beam 44. The first beam 42 and the second beam 44 are secured to the floating vessel 15.

A first piece of well access equipment 13*a* is disposed on the floating vessel 15. A second piece of well access equipment 13*b* is disposed on the floating vessel.

Figure 8:
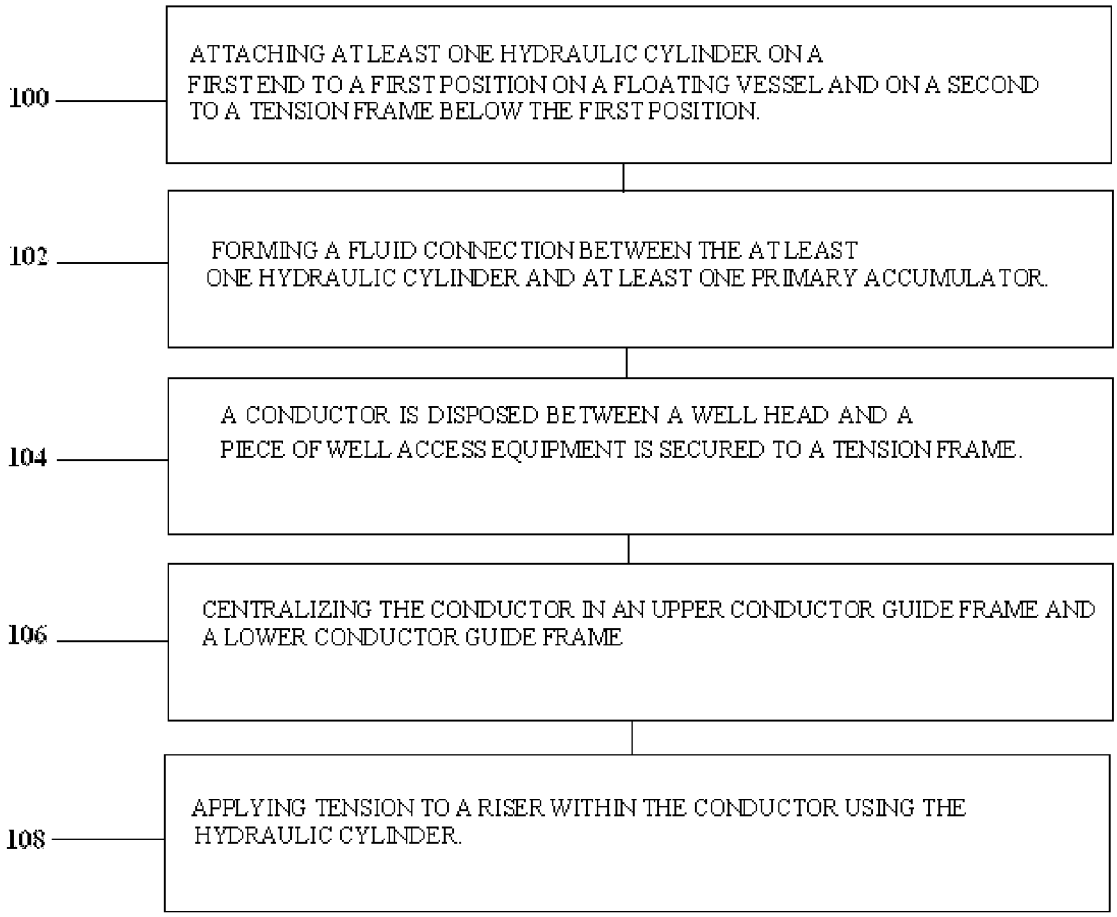
FIG. 8 is a flow diagram of the method for supporting top tension drilling and production risers on a floating vessel.

FIG. 8 depicts a flow diagram of an embodiment of the method. The depicted embodiment of the method for supporting top tension drilling and production risers on a floating vessel using a tensioner assembly above the water line of the vessel, starts with step 100, which includes attaching at least one hydraulic cylinder on a first end to a first position on a floating vessel and on a second end to a tension frame below the first position.

After the hydraulic cylinder is attached to the floating vessel the method continues with step 102, which includes forming a fluid connection between the at least one hydraulic cylinder and at least one primary accumulator. In step 104, a conductor is disposed between a well head and a piece of well access equipment is secured to a tension frame.

After the conductor is secured to the tension frame the method continues by centralizing the conductor in an upper conductor guide frame and a lower conductor guide frame, in step 106. The upper conductor guide frame and the lower conductor guide frame are secured to the floating vessel.

In step 108 the method includes applying tension to a riser within the conductor using the hydraulic cylinder. The conductor slidably supports top tension drilling and production risers.

While these embodiments have been described with emphasis on the embodiments, it should be understood that within the scope of the appended claims, the embodiments might be practiced other than as specifically described herein.

What is claimed is:

1. A method for supporting top tension drilling and production risers on a floating vessel using a tensioner assembly above the water line of the floating vessel, comprising:

a. attaching at least one hydraulic cylinder on a first end to a first position on a floating vessel and on a second end to a tension frame below the first position;

b. forming a fluid connection between the at least one hydraulic cylinder and at least one primary accumulator;

c. securing a conductor disposed between a wellhead and a piece of well access equipment to the tension frame;

d. centralizing the conductor in an upper conductor guide, the upper conductor guide having an upper guide retaining ring and upper conductor guide wear pad, and a lower conductor guide, the lower conductor guide having an lower guide retaining ring and lower conductor guide wear pad, wherein the conductor is in slidable engagement with the upper connector guide and engagement with the lower connector guide, wherein the upper conductor guide and the lower conductor guide are secured to the floating vessel;

e. applying tension to a riser within the conductor using the at least one hydraulic cylinder by applying tension to the riser through the conductor and the tension frame with the hydraulic cylinder, wherein the tension frame is mounted with the conductor and the riser is secured within the conductor such that the conductor pulls the riser when tension is applied to the conductor; and f. wherein the conductor slidably supports top tension drilling and production risers.

2. The method of claim 1, further comprising using a support frame to mount the at least one hydraulic cylinder and the at least one primary accumulator, and then securing the support frame to the floating vessel.

3. The method of claim 2, wherein the support frame comprises a first beam and a second beam.

4. The method of claim 2, wherein the support frame is a cassette.

5. The method of claim 2, wherein the support frame is welded to the floating vessel.

6. The method of claim 1, wherein the at least one hydraulic cylinder can be secured to the floating vessel by shackles, pins, or other rotating members adapted to form rotatable joints.

7. The method of claim 1, wherein each primary accumulator is secured proximate to one of the at least one hydraulic cylinders.

8. The method of claim 1, wherein at least one primary accumulator is remote to the hydraulic cylinder.

9. The method of claim 1, further comprising a self supporting frame disposed on the floating vessel for supporting the at least one hydraulic cylinder for tensioning the riser.

10. The method of claim 1, wherein the at least one hydraulic cylinder comprises a plurality of hydraulic cylinders secured to the vessel.

11. The method of claim 1, further simultaneously using each hydraulic cylinder to apply tension to a riser within the conductor.

12. The method of claim 1, wherein the vessel is a tension leg platform, a deep draft cassion vessel, a semi-submersible, a ship, or a barge.

* * * * *